US010898912B2

(12) United States Patent
Hoxie et al.

(10) Patent No.: US 10,898,912 B2
(45) Date of Patent: Jan. 26, 2021

(54) NOZZLES AND METHODS OF MIXING FLUID FLOWS

(71) Applicant: Regents of the University of Minnesota, Minneapolis, MN (US)

(72) Inventors: Alison Hoxie, Duluth, MN (US); Paul John Strykowski, Plymouth, MN (US); Vinod Srinivasan, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 101 days.

(21) Appl. No.: 15/755,659

(22) PCT Filed: Aug. 26, 2016

(86) PCT No.: PCT/US2016/049069
§ 371 (c)(1),
(2) Date: Feb. 27, 2018

(87) PCT Pub. No.: WO2017/040314
PCT Pub. Date: Mar. 9, 2017

(65) Prior Publication Data

US 2019/0015855 A1 Jan. 17, 2019

Related U.S. Application Data

(60) Provisional application No. 62/211,440, filed on Aug. 28, 2015.

(51) Int. Cl.
*B05B 7/10* (2006.01)
*B05B 1/08* (2006.01)
(Continued)

(52) U.S. Cl.
CPC ..... *B05B 7/10* (2013.01); *B05B 1/08* (2013.01); *B05B 7/0475* (2013.01);
(Continued)

(58) Field of Classification Search
CPC ..... F23D 14/62; F23D 11/102; F23D 11/38; B05B 1/08; B05B 7/10; B05B 7/0475
See application file for complete search history.

(56) References Cited

U.S. PATENT DOCUMENTS 2,149,115 A 11/1936 De Foe et al.
4,526,322 A 7/1985 Voorheis
(Continued)

FOREIGN PATENT DOCUMENTS

CN 102272524 A1 12/2011
JP 2012145026 A 8/2012
(Continued)

OTHER PUBLICATIONS

Ganan Calvo, "Enhanced liquid atomization: From flow-focusing to flow-blurring", Applied Physics Letters, 86, 214101 (2005) (4 pgs.).
(Continued)

*Primary Examiner* — Qingzhang Zhou
(74) *Attorney, Agent, or Firm* — Dicke, Billig & Czaja, PLLC

(57) ABSTRACT

A nozzle assembly including an inner tube and an outer housing. The inner tube terminates at an outlet end and defines a first flow passage. The first flow passage directs first fluid flow to the outlet end in a primary flow direction. The outer housing includes a tubular side wall and an end wall. The tubular side wall defines a central axis. The end wall defines an exit orifice and an interior guide structure. The outlet end is axially aligned with the exit orifice. A second flow passage is established between the inner tube and the outer housing. The interior guide structure is configured and arranged relative to the outlet end to direct at least a portion of a second fluid flow from the second flow passage toward the outlet end in a direction initially opposite the primary flow direction for generating mixed fluid flow.

10 Claims, 12 Drawing Sheets

(51) Int. Cl.

| | |
|---|---|
| ***B05B 7/04*** | (2006.01) |
| ***F23D 11/10*** | (2006.01) |
| ***F23D 11/38*** | (2006.01) |
| ***F23D 14/62*** | (2006.01) |

(52) U.S. Cl.
CPC ..... *F23D 11/102* (2013.01); *F23D 11/38* (2013.01); *F23D 14/62* (2013.01)

(56) References Cited

U.S. PATENT DOCUMENTS

| | | | | |
|---|---|---|---|---|
| 5,692,678 | A | 12/1997 | Ishibashi et al. | |
| 5,868,322 | A | 2/1999 | Loucks, Jr. et al. | |
| 8,028,934 | B2 | 10/2011 | Wurz et al. | |
| 8,201,351 | B2 | 6/2012 | Ganan Calvo | |
| 8,590,812 | B2 | 11/2013 | Wurz | |
| 8,967,496 | B1 * | 3/2015 | Blake | B05B 7/0475 239/322 |
| 2004/0222317 | A1 | 11/2004 | Huffman | |
| 2011/0045425 | A1 | 2/2011 | Agrawal et al. | |
| 2013/0319301 | A1 | 12/2013 | Okazaki et al. | |

FOREIGN PATENT DOCUMENTS

| | | | |
|---|---|---|---|
| WO | 00/76673 | A1 | 12/2000 |
| WO | 0202210 | A1 | 1/2002 |
| WO | 2005/018817 | A2 | 3/2005 |

OTHER PUBLICATIONS

K. Merkle et al., "Effect of co- and counter-swirl on the isothermal flow- and mixture-field of an airblast atomizer nozzle", International Journal of Heat and Fluid Flow, 24(4):529-537, Aug. 2003 (9 pgs.).

S. Sadik et al., "On the mechanism of spray formation from liquid jets", Journal of Colloid and Interface Science, 259 (2003) 261-274 (14 pgs.).

Search Report and Written Opinion for International Application No. PCT/US16/49069 dated Dec. 30, 2016 (14 pgs.).

Extended European search report in related application No. 16842701.1 dated Mar. 11, 2019 (8 pages).

* cited by examiner

NOZZLES AND METHODS OF MIXING FLUID FLOWS

CROSS-REFERENCE TO RELATED APPLICATIONS

This Utility Patent Application claims priority under 35 U.S.C. § 371 to International Application Serial No. PCT/US2016/049069, filed Aug. 26, 2016, which claims the benefit of Provisional Patent Application No. 62/211,440, filed Aug. 28, 2015; which are both incorporated herein by reference in their entirety.

BACKGROUND

Nozzles, such as atomizer nozzles, are sometimes used to atomize liquid flows. Atomized liquid flows (e.g., sometimes referred to as aerosolized liquid flows, such as aerosol sprays) include droplets of the liquid dispersed in a gas, such as air. For example, a liquid flow may be atomized by directing a gas flow into the liquid flow to create the liquid droplets. In some examples, liquid fuels might be atomized for use in gas-turbine combustors, boilers, etc. In other examples, liquids, such as paints or other coatings, might be atomized for spray-coating applications, such as painting applications. Liquid pesticides, herbicides, etc. might be atomized, for example, for spraying.

By way of further example, combustion engines rely on rapid atomization of liquid fuel prior to combustion. In general, atomization of a liquid spray is governed by its fluid properties, density, viscosity, and surface tension, as well as the inertial forces created by the delivery setup. Conventional air assist atomizer nozzle constructions (e.g., air is blasted along the liquid stream as it exits the nozzle) employed with gas turbine engines and the like are well-suited for the rapid atomization of petroleum fuels. However, air assist atomizer nozzle constructions are less able to sufficiently atomize some alternative fuel sources such as biomass-based neat oils (bio-oil), etc., due in large part to the significantly higher viscosity of the bio-oil component (as compared to the viscosity of diesel and other petroleum fuels). For example, while soybean oil is akin to diesel in terms of density and surface tension, the viscosity of soybean oil is 25 times greater than that of diesel. Straight vegetable oil has been shown to cause operational and durability problems in compression engines due to this high viscosity and low ignitability. With conventional air assist atomizer nozzle constructions, the dynamic effect of this increased viscosity is to significantly reduce the Reynolds number of the jet as it leaves the nozzle, inhibiting liquid jet breakup and leading to insufficient levels of atomization.

An alternative atomization nozzle configuration is described in U.S. Pat. No. 8,201,351 (Ganan Calvo), and is referred to as flow-blurring atomization. Flow-blurring is developed by bifurcating the atomizing gas stream within and outside of the exit region of the nozzle. It is believed that flow-blurring atomization with high viscosity fuels may be possible. However, onset of the flow-burring regime may be dependent upon specific geometry relationships of the nozzle components, and may not afford the ability to selectively alter properties of the atomized liquid.

In light of the above, a need exists for nozzles capable of atomizing high viscosity liquids, such as, for example, bio-oils, as well as other fluid mixing applications (e.g., liquid-gas mixing or systems, gas-gas systems, or liquid-liquid systems).

SUMMARY

Some aspects of the present disclosure are directed toward a nozzle assembly. The assembly includes an inner tube and an outer housing. The inner tube terminates at an outlet end and defines a first flow passage. The first flow passage is open to the outlet end for directing a first fluid flow to the outlet end in a primary flow direction. The outer housing includes a tubular side wall and an end wall. The tubular side wall defines a central axis; in some embodiments, the tubular side wall and the inner tube are coaxially arranged and together define the central axis. The end wall defines an exit orifice and an interior second fluid flow guide structure; in some embodiments, the end wall provides a centrally located opening that defines the exit orifice. The inner tube is assembled to the outer housing such that the outlet end is axially aligned with the exit orifice (e.g., a portion of the inner tube is assembled within the outer housing). Further, a segment of the inner tube, including the outlet end, is radially within the tubular side wall to establish a second flow passage between the inner tube and the outer housing. The interior guide structure is configured and arranged relative to the outlet end to direct at least a portion of second fluid flow from the second flow passage toward the outlet end in a direction initially opposite the primary flow direction for generating fluid mixture flow, such as an atomizing liquid flow. In some embodiments, the nozzle assembly is configured such that an axial distance between the outlet end and the end wall is adjustable. In other embodiments, the interior guide structure includes a guide surface and a guide post. The guide post projects from the guide surface in a direction of the inner tube, and defines a lumen that is fluidly open to the exit orifice; second fluid flow is directed along the guide post toward the outlet end of the inner tube as a function of a spatial relationship of the lumen relative to the first flow passage of the inner tube.

Other aspects of the present disclosure are directed toward a method of generating a mixed fluid flow, for example atomizing a liquid flow. The method includes conveying a first fluid flow along a first flow passage of an inner tube in a primary flow direction toward an outlet end of the inner tube. The inner tube is included with a nozzle assembly that further includes an outer housing having an end wall defining an exit orifice. While the first fluid flow is conveyed through the first flow passage, a second fluid flow is conveyed through a second flow passage defined between the outer housing and the inner tube. The first and second fluids can be liquid or a gas (e.g., the first fluid flow is a liquid and the second fluid flow is a gas, the first fluid flow is a gas and the second fluid flow is a liquid, the first and second fluids flows are both gas, or the first and second fluid flows are both liquid). At least a portion of the second fluid flow is directed from the second flow passage toward the outlet end in a direction initially opposite the primary flow direction to generate a fluid mixture, for example an atomized liquid flow (also referred to as an atomized liquid and gas two-phase flow) in some non-limiting embodiments. The fluid mixture (e.g., atomized liquid and gas two-phase flow) is dispensed through the exit orifice. In some embodiments, the step of directing at least a portion of the second fluid flow includes establishing a low-density flow stream on an outer annulus of the first fluid flow. In other embodiments, the fluid mixture is a pulsating atomized liquid flow, and the method optionally further includes adjusting a frequency of the pulsating atomized liquid flow.

The nozzle assemblies and methods of the present disclosure are well-suited for atomizing a plethora of different liquids and useful with a multitude of spraying applications, as well as many other fluid mixture scenarios (e.g., gas-gas mixtures and liquid-liquid mixtures). Notably, unlike conventional atomizer nozzle constructions, the nozzle assemblies and methods of the present disclosure can rapidly atomize high viscosity liquids, capable of efficiently atomizing heavy biofuels therefore allowing for more efficient and clean combustion of those fuels.

DETAILED DESCRIPTION

Aspects of the present disclosure relate to nozzles or nozzle assemblies, and related methods of use, in which a two fluid flows are mixed by directing a first fluid flow into a second fluid flow in a direction that is counter to the direction of the second flow to create a mixed fluid flow. In some non-limiting embodiments, the nozzle assemblies of the present disclosure and related methods of use entail generating an atomized liquid-gas two phase flow that includes droplets of the liquid dispersed within the gas. Optionally, nozzle assemblies of the present disclosure provide the ability to generate a pulsed fluid flow (e.g., a pulsed atomization flow) with a selected pulse frequency.

Figure 1A:
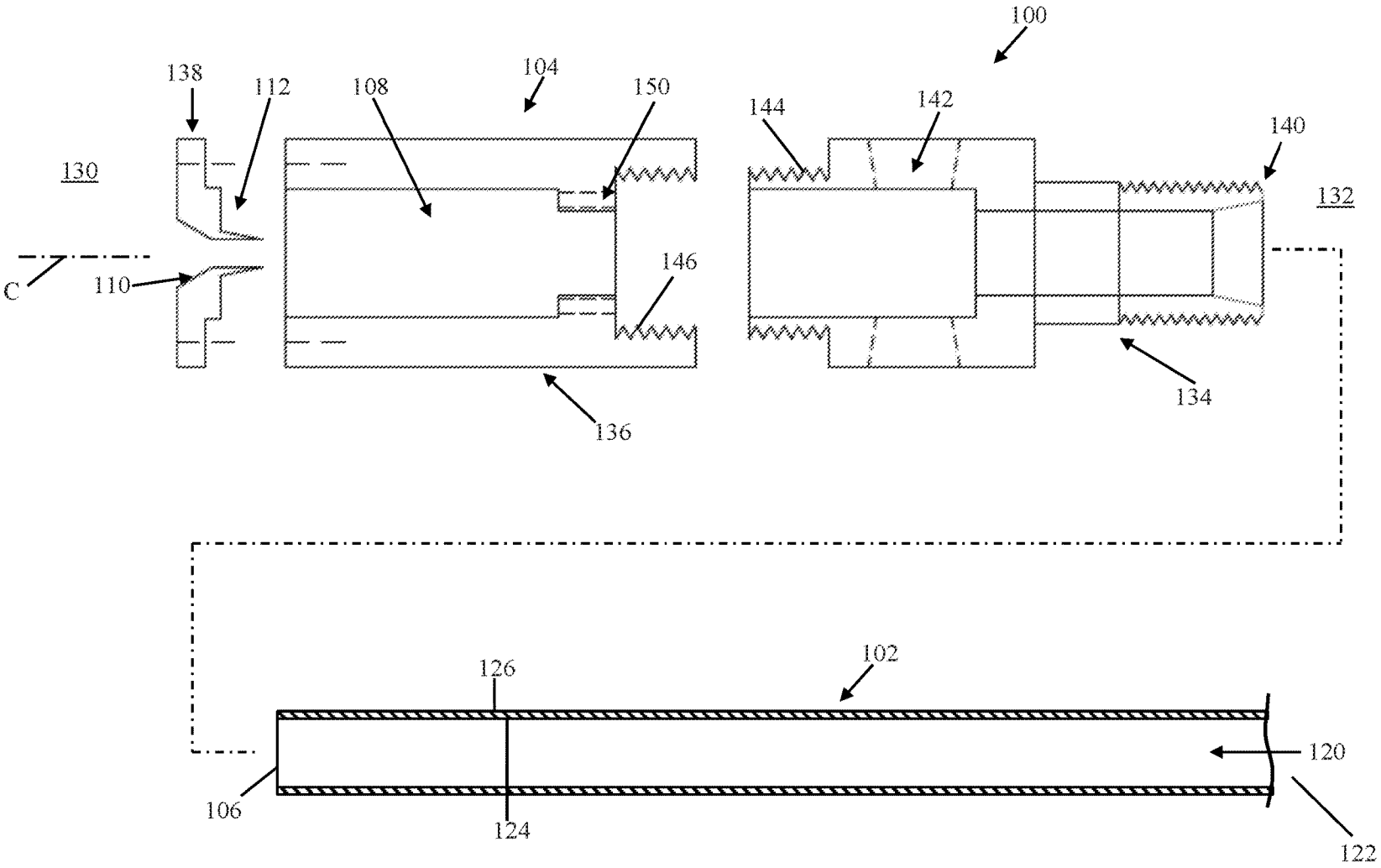
FIG. 1A is a simplified, exploded, cross-sectional view of a nozzle assembly in accordance with principles of the present disclosure.

One embodiment of a nozzle assembly 100 in accordance with principles of the present disclosure is shown in FIG. 1A. The nozzle assembly (or "counterflow nozzle") includes an inner tube 102 and an outer housing 104. Details on the various components are described below. In general terms, however, the inner tube 102 defines an outlet end 106. The outer housing 104 defines a chamber 108 and an exit orifice 110. The inner tube 102 is configured for mounting to the outer housing 104 such that the outlet end 106 is within the chamber 108 and axially aligned and radially symmetric with the exit orifice 110. As a point of reference, various features of the nozzle assemblies of the present disclosure can be described with reference to a central (or longitudinal) axis C defined by the outer housing 104 (e.g., as used herein, directional terms such as "axial" and "radial" are relative to the central axis C) alone or as defined by an optional coaxial arrangement of the inner tube 102 and the outer housing 104. During use, and as generally reflected by FIG. 1B, a first fluid flow F1 (liquid or gas) is conveyed through the inner tube 102 and a second fluid flow F2 (liquid or gas) into the chamber 108. The second fluid flow F2 within the chamber 108 is at least partially directed toward the outlet end 106, generating a mixed fluid flow A adjacent, within, or into the inner tube 102 (e.g., a gas flow (either F1 or F2) atomizes a liquid flow (the other of F1 or F2) in some non-limiting embodiments); the mixed fluid flow A is then directed or dispensed through the exit orifice 110. As described below, an interior guide structure 112 provided with the outer housing 104 is configured and arranged relative to the outlet end 106 such that at least a portion of the second fluid flow F2 is directed toward (or into) the outlet end 106 in a direction that is initially opposite, optionally fully opposite, the primary direction of the first fluid flow F1. In some embodiments, the nozzle assembly 100 is configured such that an axial arrangement of the outlet end 106 relative to the interior guide structure 112 can be selectively altered to generate a pulsed mixed fluid flow (e.g., a pulsed atomized flow) at the exit orifice 110, with the pulse rate of the pulsing mixed fluid flow optionally being selected by a user.

Returning to FIG. 1A, the inner tube 102 can assume various forms appropriate for interfacing with a desired fluid, either liquid (e.g., bio-oil fuel) or gas (e.g., air). The inner tube 102 can have a circular cross-sectional shape as generally reflected by the views; alternatively, other shapes (e.g., square, hexagonal, etc.) are also envisioned. Regardless, the inner tube 102 defines a first flow passage 120 that is open to the outlet end 106 such that the first fluid (not shown) can be directed to the outlet end 106 from an inlet end 122 (referenced generally) via the first flow passage 120. The first flow passage 120 is bounded or defined by an inner surface 124 of the inner tube 102, with the inner surface 124 being opposite an outer surface 126. While the inner tube 102 is illustrated as being substantially linear, other shapes are also envisioned; for example, portions of the inner tube 102 that are otherwise beyond or outside of the outer housing 104 can incorporate one or more curves, can be flexible, etc.

The outer housing 104 generally defines opposing, first and second sides 130, 132, and can assume a variety of forms. In some embodiments, for example, the outer housing 104 can completed by the assembly of two or more separate components or sections, such as an inlet section 134, a chamber section 136 and an end cap 138. The inlet section 134 is sized and shaped to receive the inner tube 102 (e.g., at a tube guide port 140), and forms or provides a fluid entry region or port 142 (referenced generally). The inlet and chamber sections 134, 136 are configured for assembly to one another (e.g., via optional complimentary threaded surfaces 144, 146, bayonets, or other mounting construction), and combine to define the complete chamber 108 as described in greater detail below. An optional flow distributor 150 is carried by the chamber section 136 (or the inlet section 134). The end cap 138 is configured for assembly to the chamber section 136, and forms the exit orifice 110. The end cap 138 (and the exit orifice 110 defined therein) is located at the first side 130, and further forms or provides the interior guide structure 112.

Figure 1B:
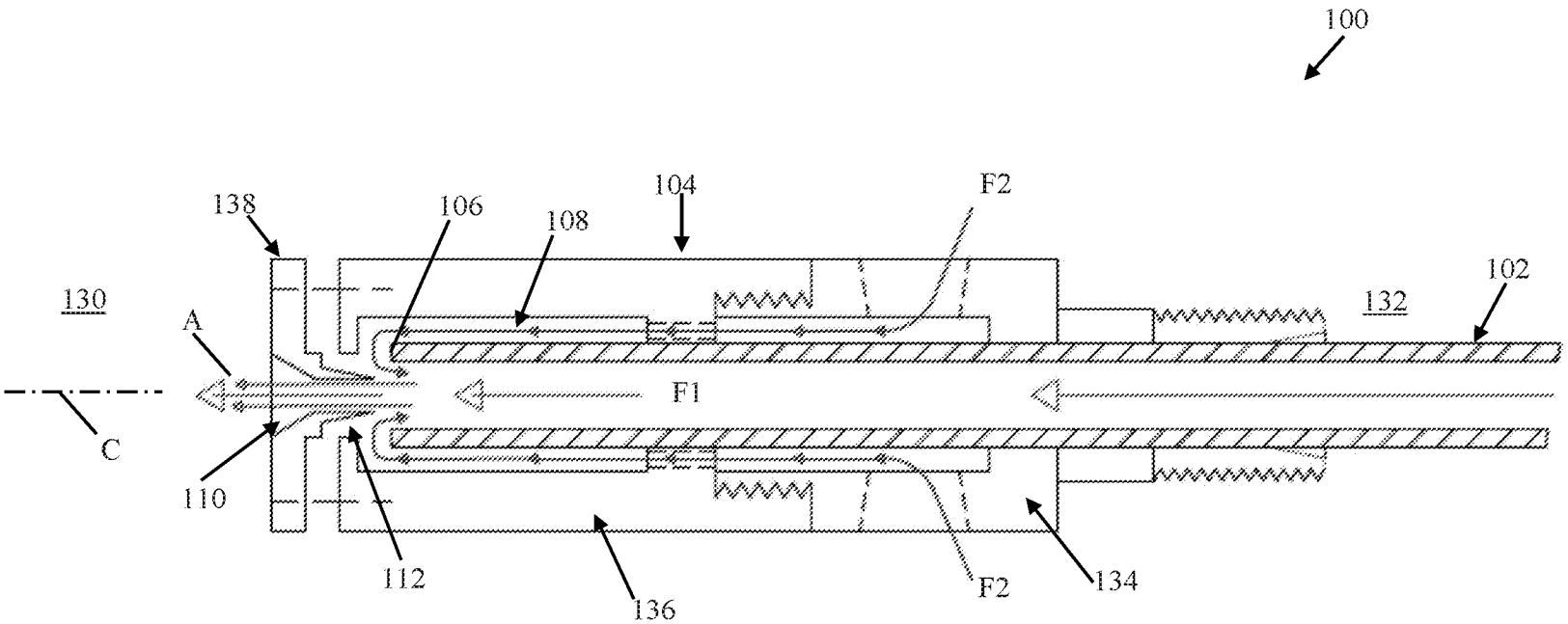
FIG. 1B illustrates the nozzle assembly of FIG. 1A upon final assembly and atomizing a liquid flow.
Figure 2A:
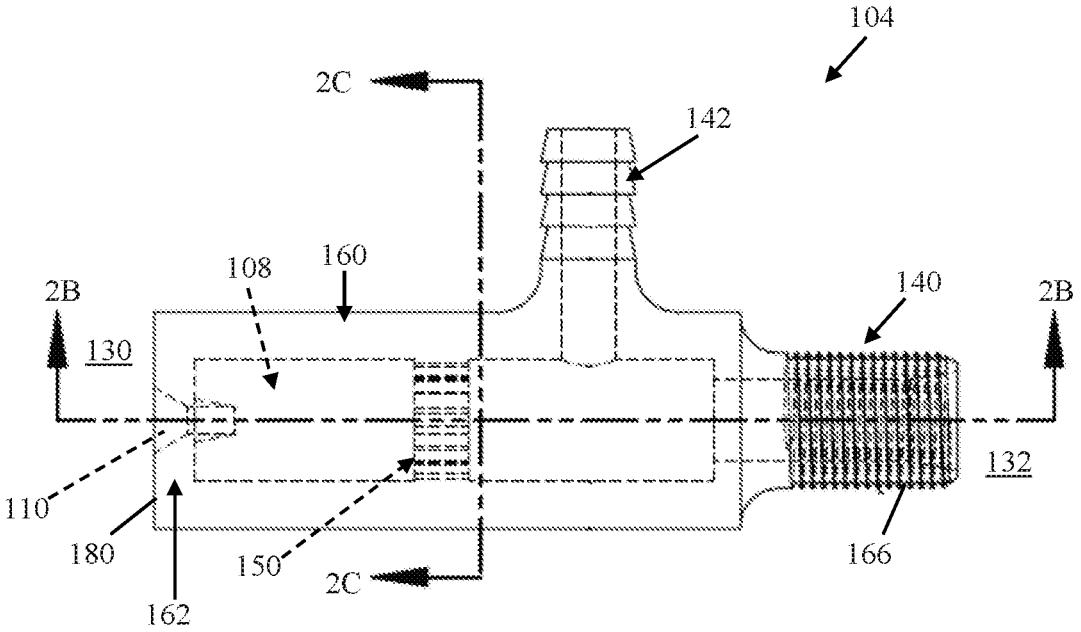
FIG. 2A is a side view of an outer housing useful with the nozzle assembly of FIG. 1A.
Figure 2B:
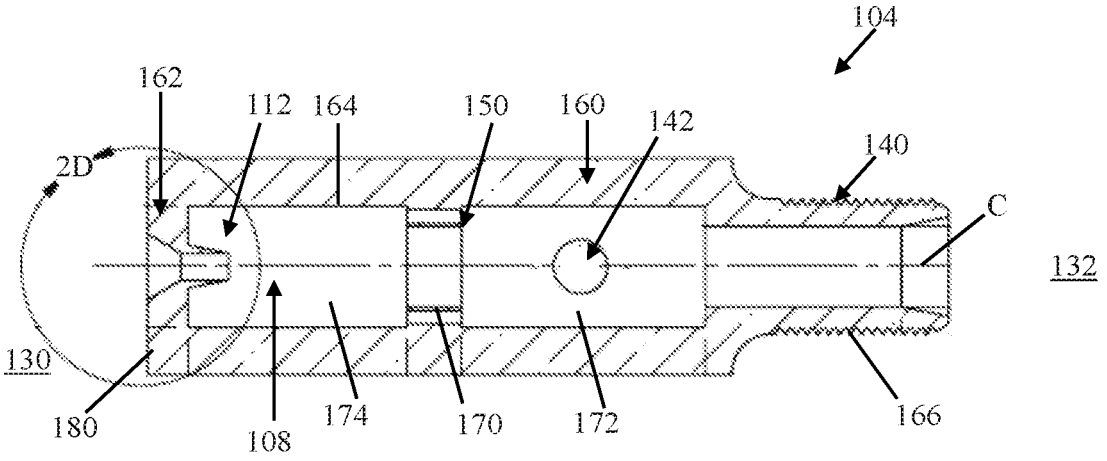
FIG. 2B is a cross-sectional view of the outer housing of FIG. 2A, taken along the line 2B-2B.
Figure 2C:
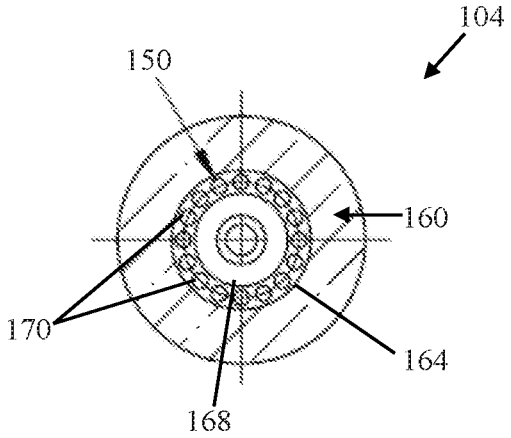
FIG. 2C is a cross-sectional view of the outer housing of FIG. 2A, taken along the line 2C-2C.

While the outer housing 104 has been described as optionally being collectively defined by multiple assembled parts or sections, an integral or homogenous construction is equally acceptable. With this in mind, FIGS. 2A and 2B represent the outer housing 104 upon final assembly, and reflect an alternative construction in which the outer housing 104 is an integral, homogenous body (i.e., the inlet section 134, the chamber section 136 and the end cap 138 of FIGS. 1A and 1B are formed as a singular structure). Regardless of how formed, the outer housing 104 can be viewed as having or providing a tubular side wall 160 and an end wall 162. The chamber 108 is bounded by an inner face 164 of the tubular side wall 160 (e.g., the chamber 108 can have a cylindrical shape), and is fluidly open to the fluid entry port 142. The tube guide port 140 is provided at the second side 132 of the outer housing 104, and also is open to the chamber 108. The tube guide port 140 is generally configured to slidably receive the inner tube 102 (FIG. 1A), and can include one or more features that promote fixed mounting of the inner tube 102 such as an optional threaded surface 166.

Where provided, the optional flow distributor 150 is intermediately located along an axial length of the chamber 108, and generally entails a radially inward projection of or from the inner face 164 of the tubular side wall 160. More particular, and as reflected in FIG. 2C, the flow distributor 150 can have a ring-like shape, terminating at a hub face 168 radially inward of the inner face 164. The hub face 168 is co-axial with the central axis C, and a diameter (or other dimension) of the hub face 168 can correspond with an outer diameter of the inner tube 102 (FIG. 1A) for reasons made clear below. Further, a plurality of axial openings 170 are defined in the flow distributor 150 radially inward of the tubular side wall 160. The axial openings 170 can be arranged in the circular pattern as shown, and each optionally extends substantially parallel with (e.g., within 10% of a truly parallel relationship) the central axis C. Other configurations of the axial openings 170 are also acceptable, such as swirled arrangement for example. In yet other embodiments, the flow distributor 150 can be a porous, plug-like structure. With additional reference to FIG. 2B, the flow distributor 150 effectively divides the chamber 108 into first and second regions 172, 174, with the axial openings 170 dictating controlled flow of fluid (either gas or liquid) from the first region 172 to the second region 174 as described below.

Returning to FIGS. 2A and 2B, the end wall 162 is located at the first side 130, and forms or defines the exit orifice 110. The exit orifice 110 is open to an exterior face 180 of the end wall 162, and can have a variety of shapes and sizes (e.g., the exit orifice 110 can have an expanding diameter in a direction of the exterior face 180 as shown). The exit orifice 110 is axially or longitudinally aligned with the central axis C in some embodiments.

Figure 2D:
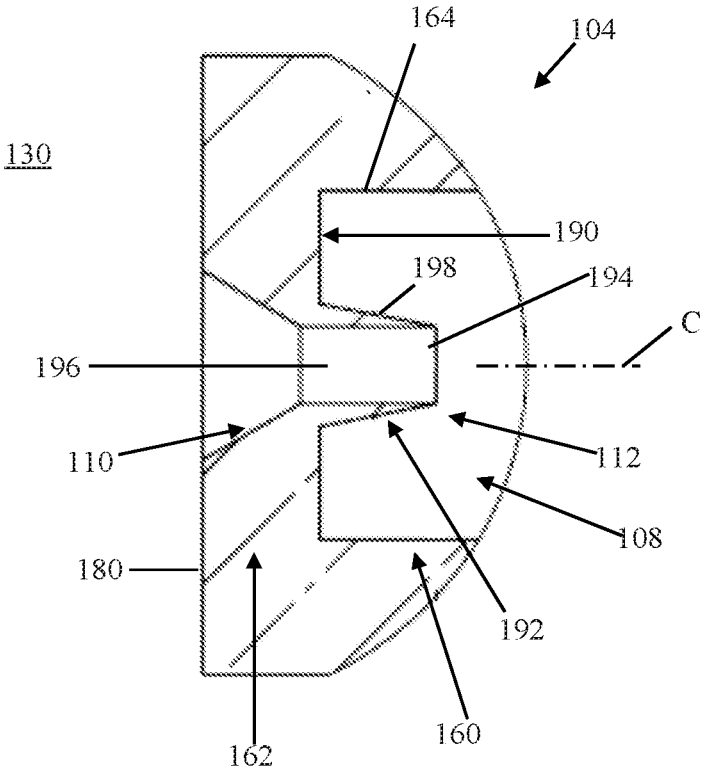
FIG. 2D is an enlarged cross-sectional view of a portion of the outer housing of FIG. 2B, taken along the line 2D.

In addition to the exit orifice 110, the end wall 162 includes, forms, or carries the interior guide structure 112 (referenced generally). One embodiment of the interior guide structure 112 is shown in greater detail in FIG. 2D, and includes a guide surface 190 and a guide post 192. The guide surface 190 is opposite the exterior face 180, and projects or extends radially inwardly from the inner face 164 of the tubular side wall 160. In some embodiments, the guide surface 190 can be highly flat or planar (e.g., within 10% of a truly flat surface) and defines a plane substantially perpendicular (e.g., within 10% of a truly perpendicular relationship) to the central axis C. The guide surface 190 can have other constructions that may or may not be highly flat or planar, for example a curved configuration. The guide post 192 projects from the guide surface 190 in a direction opposite the first side 130 (i.e., in a direction opposite the exterior face 180 of the end wall 162), terminating at a post end 194 opposite the guide surface 190. The guide post 192 is axially aligned with the exit orifice 110, and forms a lumen 196 that is open to the exit orifice 110 and the post end 194. As described in greater detail below, an exterior face 198 of the guide post 192 serves to direct fluid flow from the guide face 190 in a desired direction, with the guide post 192 having a tapering outer diameter in extension from the guide face 190 to the post end 194 (e.g., a shape of the guide post 192 can be akin to a cone). The taper can be uniform along an axial length of the exterior face 198; in other embodiments, differing degrees of taper can be incorporated and/or portions of the exterior face 198 can be linear (i.e., parallel with the central axis C) in axial length. The exterior face 198 can be substantially smooth in some embodiments. Alternatively, one or more flow-affecting features can be incorporated, such as a spiral (e.g., a helical) step (e.g., ramp) as described below. With optional embodiments in which the guide surface 190 is curved, the exterior face 198 of the guide post 192 can be formed or defined as continuous surface extension of the curved shaped of the guide surface 190. Regardless, the guide post 192 is radially spaced from the tubular side wall 160 and projects into the chamber 108.

Figure 3A:
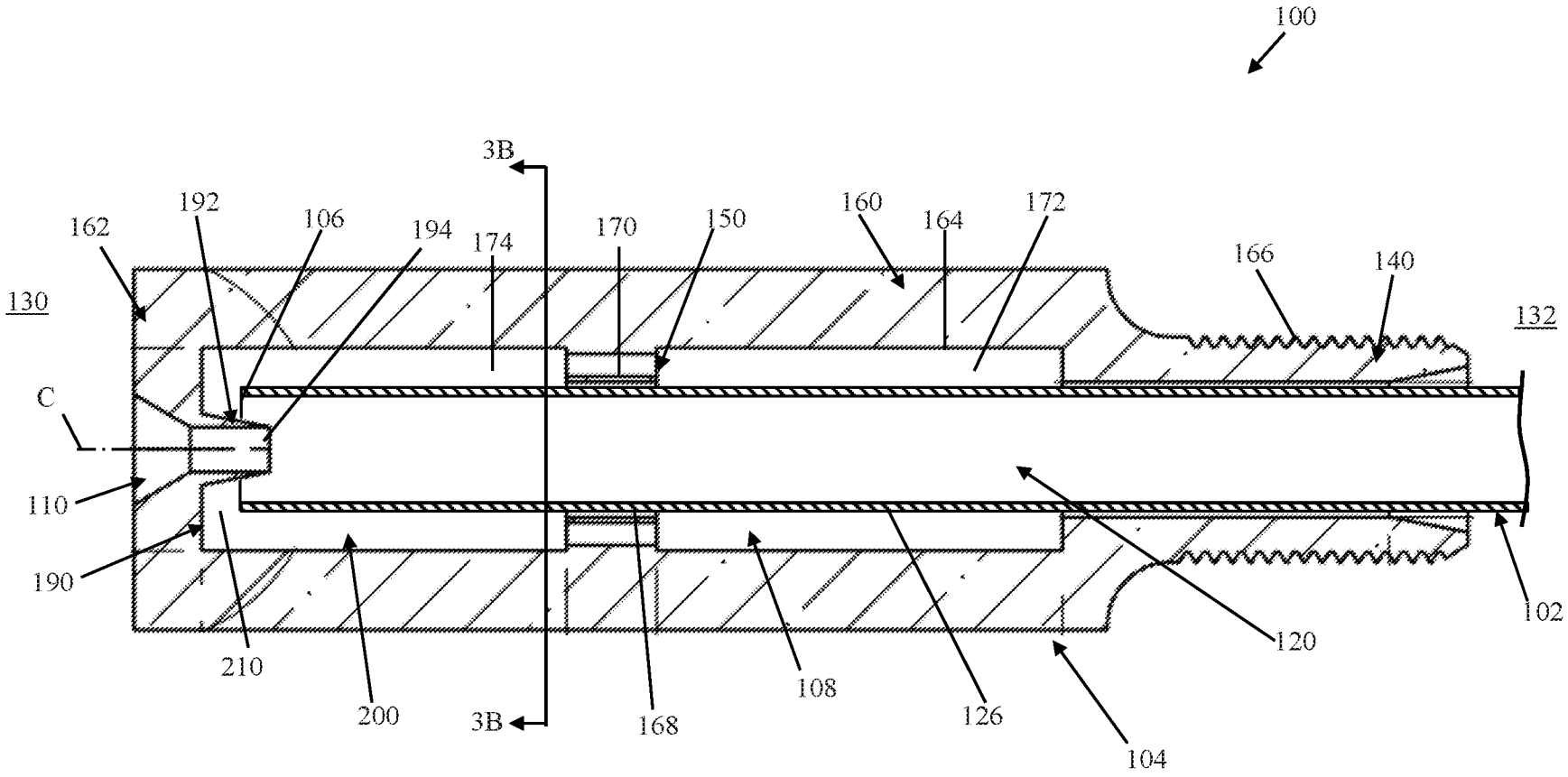
FIG. 3A is a simplified, cross-sectional view of a nozzle assembly in accordance with principles of the present disclosure and including the outer housing of FIG. 2A.
Figure 3B:
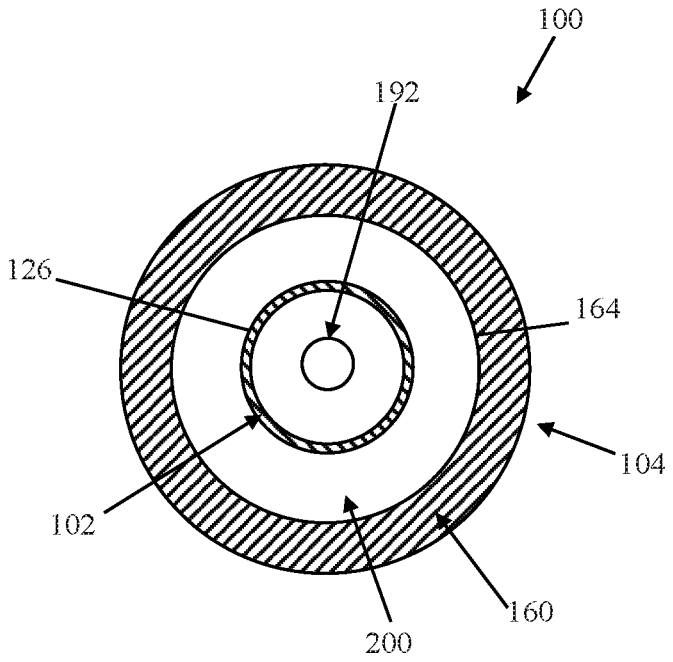
FIG. 3B is a cross-sectional view of the nozzle assembly of FIG. 3A, taken along the line 3B-3B.

Final construction of the nozzle assembly 100 is shown in FIG. 3A. The inner tube 102 is inserted through the tube guide port 140 and arranged such that at least a segment of the inner tube 102, including the outlet end 106, is within the chamber 108. The inner tube 102 is co-axially aligned with the central axis C, with the outlet end 106 being axially aligned with the guide post 192 and thus the exit orifice 110. Where provided, the hub face 168 (referenced generally) of the optional flow distributor 150 supports the inner tube 102 in this axially aligned relationship. Regardless, an outer diameter of the inner tube 102 is less than a diameter of the chamber 108 (at least along the inner face 164 of the tubular side wall 160), establishing a second flow passage or path 200 between the inner face 164 of the tubular side wall 160 and the outer surface 126 of the inner tube 102. Due to a radial spacing between an entire perimeter of the inner tube 102 and the inner face 164 of the tubular side wall 160, the second flow passage 200 can have an annular shape, as further reflected by the view of FIG. 3B. Returning to FIG. 3A, the flow distributor 150 is interposed along the second flow passage 200, with the second flow passage 200 progressing (relative to an intended direction of fluid flow) from the fluid entry port 142 (hidden in FIG. 3A, but shown, for example, in FIGS. 2A and 2B), along the first region 172, through the axial openings 170, and into the second region 174. The flow distributor 150 thus combines with the inner tube 102 to establish a plenum in the second flow passage 200 at the first region 172. The flow distributer 150 may act to straighten the fluid flow (i.e., the second fluid flow F2 of FIG. 1B), for example, to a direction parallel with the first flow passage 120, to distribute the second fluid flow F2, e.g., uniformly, about the annular second flow passage 200, or to induce a swirl into the second fluid flow as it moves through the second flow passage 200, etc.

An axial relationship of the outlet end 106 relative to the end wall 162 generally entails the outlet end 106 being axially spaced away from the guide face 190 (i.e., the outlet end 106 is axially off-set from the guide face 190 in a direction of the second side 132). A gap 210 is established between the outlet end 106 and the guide face 190. The gap 210 is fluidly open to, and thus fluidly connects or couples, the second flow passage 200 and the first flow passage 120. An outer diameter of the guide post 192 is, in some embodiments, less than a diameter of the first flow passage 120 (i.e., less than an inner diameter of the inner tube 102). Thus, with the one optional arrangement of FIG. 3A, the inner tube 102 is axially located such that the post end 194 of the guide post 192 is within the inner tube 102 (i.e., a portion of the guide post 192 projects into the first flow passage 120). In other words, an axial length or height of the gap 210 is less than an axial length or height of the guide post 192. Alternatively, and as described in greater detail below, the inner tube 102 can be located such that guide post 192 is entirely outside of the inner tube 102 (i.e., the outlet end 106 is axially off-set from the post end 194 in a direction of the second side 132). Regardless, in some embodiments, a fastener (not shown) can be employed to selectively lock the inner tube 102 relative to the outer housing 104 once a desired axial arrangement of the inner tube 102 is achieved (e.g., the fastener is secured to the threaded surface 166 of the tube guide port 140). A user can thus select a desired axial location of the inner tube 102. Other mounting constructions facilitating selective arrangement of the inner tube 102 relative to the outer housing 104 are equally acceptable. In yet other embodiments, the inner tube 102 can be permanently attached to the outer housing 104. Regardless, the nozzle assembly 100 can include one or more sealing members (not shown), such as a gasket, o-ring, etc., to promote a fluid-tight seal between an exterior of the inner tube 102 and the outer housing 104.

Figure 4:
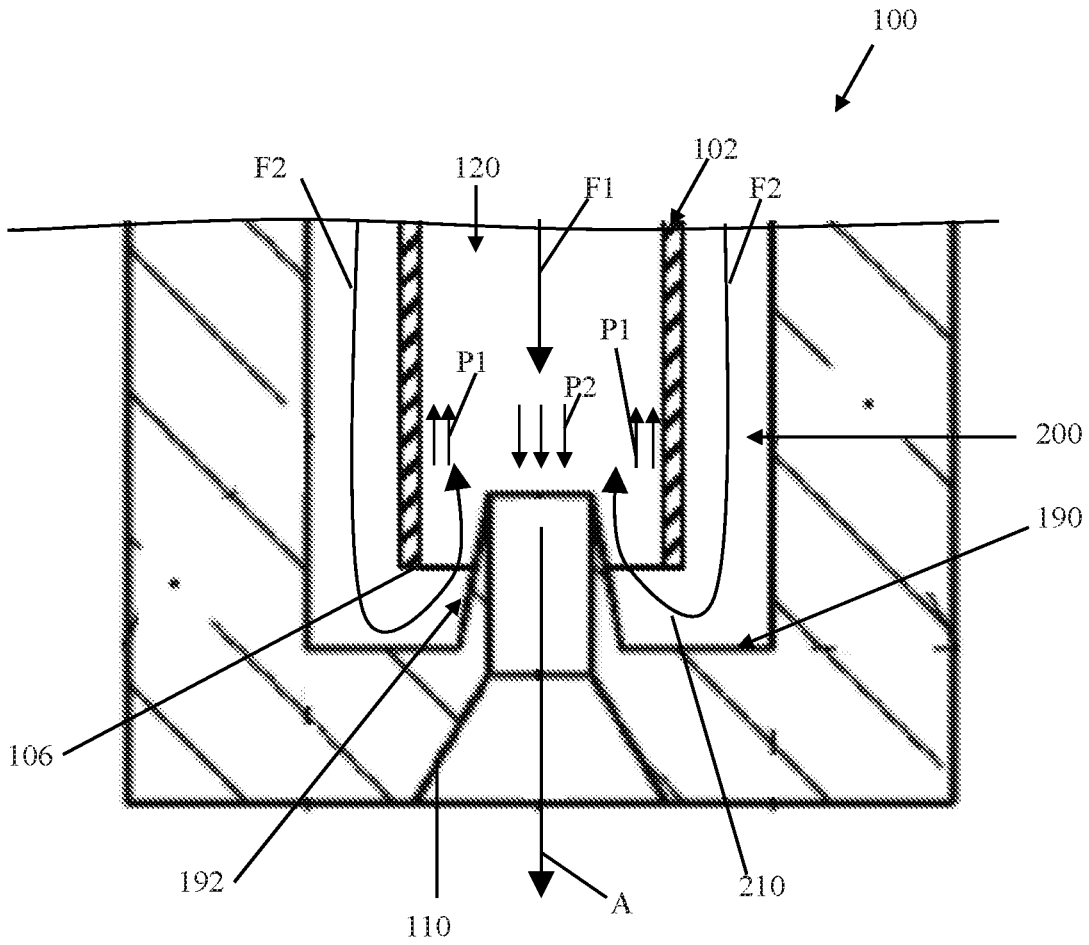
FIG. 4 is an enlarged, cross-sectional view of a portion of the nozzle assembly of FIG. 3A and illustrating one example of fluid flows generated by the nozzle assembly during use.

During use, a first fluid stream is introduced into the inner tube 102, and is caused to flow along the first flow passage 120 in a direction of the outlet end 106 (i.e., primary flow direction). A second fluid stream is simultaneously introduced at the fluid entry port 142 (hidden in FIG. 3A, but shown, for example, in FIGS. 2A and 2B), caused to flow along the second flow passage 200. In some embodiments, the first fluid stream is liquid and the second fluid stream is gas; in other embodiments, the first fluid stream is gas and the second fluid stream is liquid. The second fluid stream flows to the gap 210 and at least a portion of the second fluid flow is directed into the first flow passage 120 via the outlet end 106 (with the one non-limiting embodiment of FIG. 4, all of the second fluid flow F2 is directed into the first flow passage 120). More particularly, and as shown in FIG. 4, the first fluid flow F1 along the first flow passage 120 is in the primary flow direction indicated by the arrow, progressing toward the outlet end 106. The second fluid flow F2 along the second flow passage 200 progresses through the gap 210 and at least a portion is directed into the outlet end 106. In this regard, the guide surface 190 and the guide post 192 effectuates an approximately 180 degree turn of the second fluid flow F2 such that at least a portion of the second fluid flow F2 enters the first flow passage 120 in a direction opposite the primary flow direction of the first fluid flow F1. The opposite flow directions of the second fluid flow F2 and the first fluid flow F1 within the inner tube 102 creates an opposing flow pattern or a countercurrent mixing region. Countercurrent mixing is known to produce exceptionally high turbulence levels. The resultant mixed fluid flow A is directed through or dispensed from the exit orifice 110.

In some embodiments, the nozzle assembly 100 is useful for atomizing liquids, with one of the first or second fluid flows F1, F2 being a liquid, and the other of the first or second fluid flows F1, F2 being a gas. As described in greater detail below, the nozzle assemblies of the present disclosure are also highly beneficial with liquid-liquid and gas-gas systems (i.e., the first and second fluid flows F1, F2 can both be liquid, or the first and second fluid flows F1, F2 can both be gas). With respect to non-limiting embodiments in which the nozzle assemblies of the present disclosure are employed for atomizing liquids, the countercurrent mixing region and corresponding high turbulence levels produce the shear needed to atomize liquids, particularly fluids of high viscosity or having unique properties (such as non-Newtonian fluids). For example, when the first fluid flow F1 is a liquid, a low density flow stream (arrows "P1" in FIG. 4) on the outer annulus of the first flow passage 120 and a high-density flow stream (arrows "P2") moving in the opposite direction flowing in the center of the first flow passage 120 are created. In other embodiments, an atomized liquid is generated by the nozzle assembly 100 with the first fluid flow F1 is a gas, and the second fluid flow F2 is a liquid. Regardless, the resulting velocity profile is very unstable, thus promoting turbulence and mixing. The added density variation can also contribute to an unstable flow field depending upon which fluid flow is at high speed (e.g., the flow field can be unstable when the high speed stream is of lower density). The unstable flow field, in turn, creates an improved atomization regime that can be extended over a wide range of operating conditions. The resultant mixed fluid flow A (e.g., atomized fluid flow) is directed through or dispensed from the exit orifice 110. The mixed fluid flow A can be achieved for multiple different nozzle geometries; the nozzle assemblies of the present disclosure do not rely upon a particular geometry relationship of a distance between the outlet end 106 and the exit orifice 110 relative to a diameter of the exit orifice 110.

In addition to mixing gas-liquid systems for atomization, the nozzle assemblies of the present disclosure are highly beneficial for mixing with liquid-liquid and gas-gas systems. For example, the bright white fine powder used to make paint pigment is titanium dioxide, which is made by mixing titanium-tetrachloride gas and water vapor. The nozzle assemblies of the present disclosure are well-suited to accomplish this mixing process to form titanium dioxide powder. Other non-limiting examples include the rapid and efficient mixing of immiscible liquids (e.g., oil and water or other slurries), two gases for combustion (e.g., methane and air), etc.

Figure 5A:
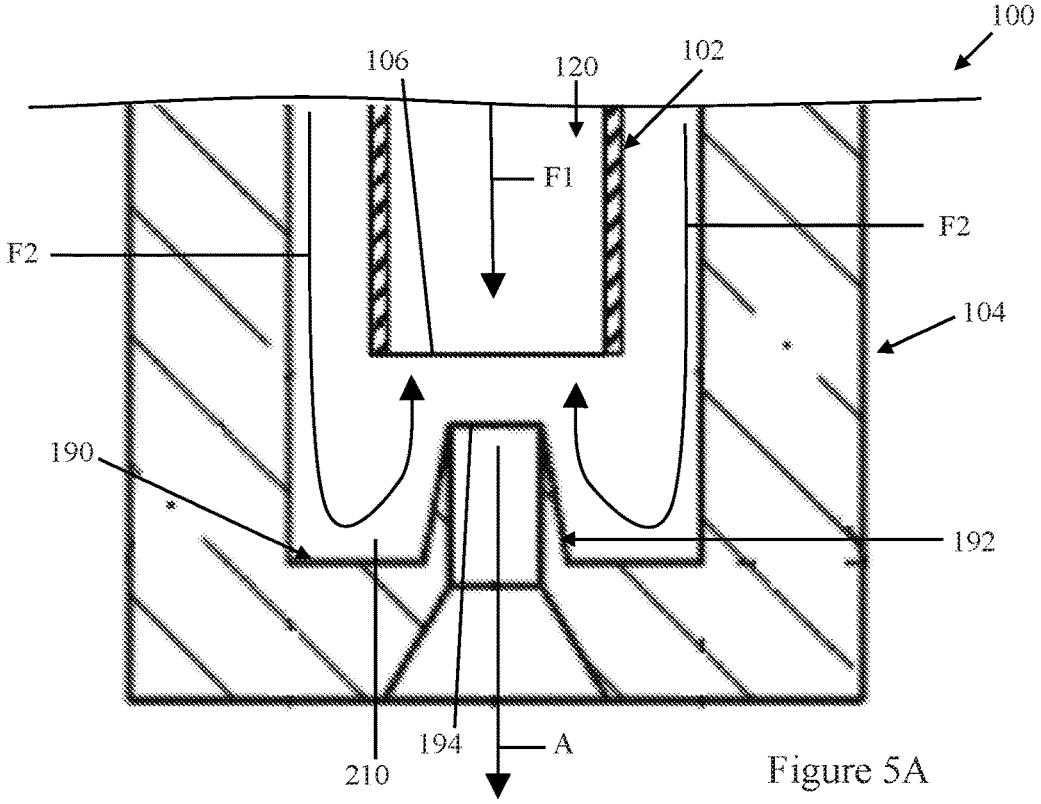
FIGS. 5A and 5B are enlarged, cross-sectional views of a portion of the nozzle assembly of FIG. 3A in an alternate configuration and illustrating another example of fluid flows generated by the nozzle assembly during use.
Figure 5B:
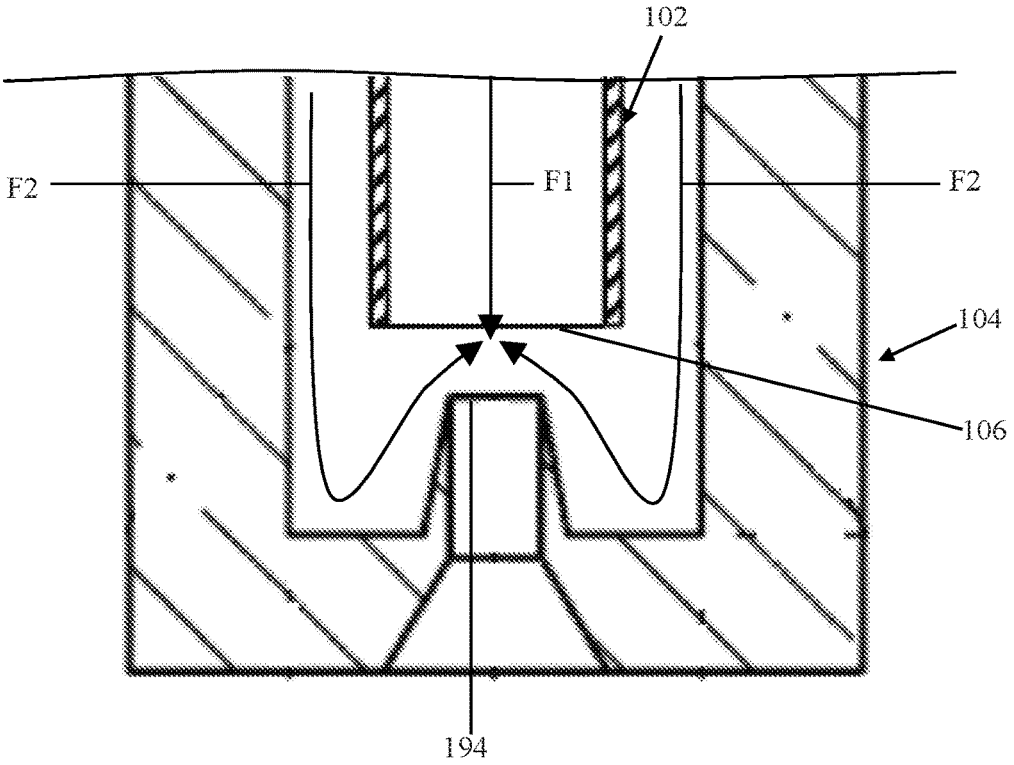

As mentioned above, in some embodiments, the nozzle assembly 100 can be configured such that the outlet end 106 of the inner tube 102 is axially off-set from the guide post 192. Flow patterns associated with this construction are represented in FIGS. 5A and 5B. Once again, the first fluid flow F1 along the first flow passage 120 is in the primary flow direction indicated by the arrow and progresses toward the outlet end 106. The second fluid flow F2 along the second flow passage 200 progresses through the gap 210 and at least a portion is directed toward the outlet end 106. In this regard, the guide surface 190 and the guide post 192 effectuates an approximately 180 degree turn of the second fluid flow F2 such that at least a portion of the second fluid flow F2 is directed toward the outlet end 106 in a direction opposite the direction of the first fluid flow F1. Due to the axial spacing between the outlet end 106 and the post end 194, a periodic spray is established. FIGS. 5A and 5B correspond to different portions of a cycle of the pulsating mixed fluid flow A (e.g., a pulsating atomized flow).

In FIG. 5A, the second fluid flow F2 periodically flows into and interfaces with the first fluid flow F1 to produce the mixed fluid flow A in accordance with the descriptions above (e.g., a low-density outer annulus flow stream (for example, where the second fluid flow F2 is gas) in one direction and a high-density center flow stream in the opposite direction). In FIG. 5B, the second fluid flow F2 periodically is more centrally directed (i.e., axially aligned with the inner tube 102), and impinges upon or partially stagnates with the first fluid flow F1. The second fluid flow F2 in the cycle state of FIG. 5B stops (e.g., blocks) the first fluid flow F1, temporarily suspending the dispensing of the mixed fluid flow A (FIG. 5A) from the exit orifice 110 (i.e., in the view of FIG. 5B, the atomized flow A of FIG. 5A does not exist). As the spacing or distance between the outlet end 106 and the post end 194 is increased, the pulse rate of the mixed fluid flow or spray A becomes slower. In some embodiments, the nozzle assemblies of the present disclosure are configured such that the frequency of the pulsating mixed fluid flow A can be user-selected by adjusting an axial location of the inner tube 102 relative to the outer housing 104, and in particular of the outlet end 106 relative to the post end 194, as described above.

Figure 6:
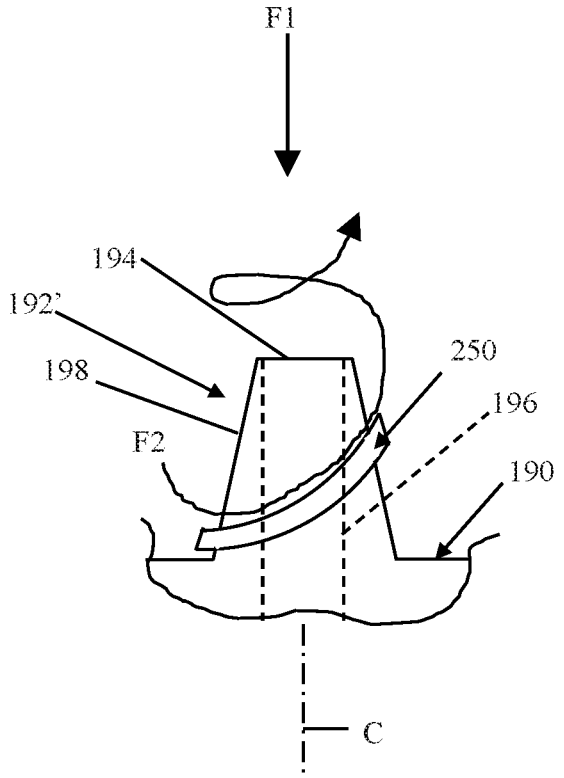
FIG. 6 is an enlarged, simplified side view of a portion of another nozzle assembly in accordance with principles of the present disclosure and including an alternative guide post.

The guide post 192 can optionally incorporate one or more features configured to affect a pattern of the second fluid flow F2. For example, an alternative guide post 192' useful with the nozzle assemblies of the present disclosure is shown in simplified form in FIG. 6. The guide post 192' is highly akin to previous descriptions, and projects from the guide surface 190 to the post end 194 as described above. As with previous embodiments, the guide post 192' defines the lumen 196 that is open to the exit orifice 110 (FIG. 1A), and has the exterior surface 198 for interfacing with the second fluid flow F2. In addition, the guide post 192' includes an optional spiral (e.g., a helical) step (e.g., ramp) 250. The spiral step 250 projects from the otherwise smooth exterior surface 198, winding around the exterior surface 198 in extension between the guide surface 190 and the post end 194. The spiral step 250 may act to impart swirl to the second fluid flow F2, such that the second fluid flow F2 swirls as it flows toward the first fluid flow F1. That is, for example, the second fluid flow F2 exhibits a circumferential (e.g., angular) flow pattern around the central axis C as it flows toward the first fluid flow F1. The swirl associated with this and other embodiments of the present disclosure can increase shear (and therefore atomization with some non-limiting embodiments), and centripetal acceleration generated by the swirling action can be used to force the second fluid flow F2 toward the centerline of the first fluid flow F1 (more notably when the second fluid flow F2 is a gas, and the first fluid flow F1 is a liquid).

Figure 7:
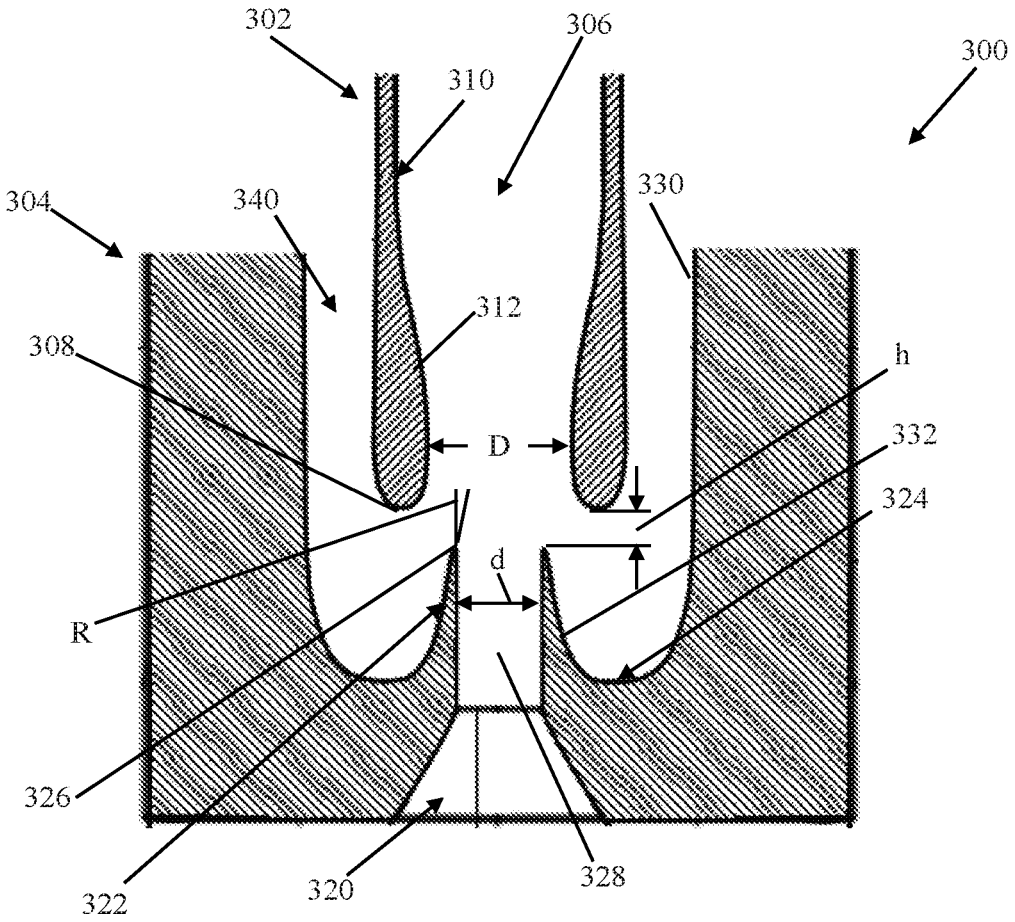
FIG. 7 is an enlarged, simplified cross-sectional view of portions of another nozzle assembly in accordance with principles of the present disclosure.

The nozzle assemblies of the present disclosure provide the ability to achieve exceptional mixing without complex actuation, forcing or other inputs. In some embodiments, the nozzle assemblies are inherently flexible in geometry, affording significant versatility over a broad range of applications. For example, portions of another embodiment nozzle assembly 300 in accordance with principles of the present disclosure are shown in simplified form in FIG. 7. The nozzle assembly 300 is akin to the descriptions above, and includes an inner tube 302 and an outer housing 304. The inner tube 302 defines a first flow passage 306 open to an outlet end 308. An interior surface 310 of the inner tube 302 exhibits or forms a curvature (indicated generally at 312) in longitudinal extension at a location adjacent the outlet end 308 as shown. This curvature effectuates a reduced diameter D of the first flow passage 306 proximate the outlet end 308. The outer housing 304 forms an exit orifice 320 and carries or defines a guide post 322. In particular, the guide post 322 projects from a guide surface 324 commensurate with the descriptions above, terminating at a post end 326. The guide post 322 is axially aligned with the exit orifice 320, and forms a lumen 328 that is open to the exit orifice 320 and the post end 326. The lumen 328 has a diameter d. The guide surface 324 is curved in extension from an inner face 330 to the guide post 322; further, an exterior surface 332 of the guide post 322 smoothly continues the curvature of the guide surface 324 as shown. A gap can be established between the outlet end 308 of the inner tube 302 and the post end 326, having a gap height h. Finally, a second flow passage 340 is formed between the inner tube 302 and the outer housing 304 in accordance with the descriptions above.

The curved or smooth surfaces of the nozzle assembly 300 as described above can be used to effectively "turn" fluid flow (not shown) along the second flow passage 340 without any sharp corners. These curved surfaces can reduce pressure loss and allow tailoring of the first and second flow streams (not shown) to control the countercurrent mixing region itself. These features can be beneficial for non-limiting applications of the nozzle assembly 300 for atomizing liquids. As a point of reference, a good atomization process may require high shear at low pressure-drop penalty and with minimal gas input; the smooth curved surfaces of the nozzle assembly 300 facilitate these goals. The shape of the curved surfaces not only produces efficient flow turning, but can also be beneficial for directing portions of the first and second fluid streams to interact. In this regard, a release angle R is identified in FIG. 7 and is intended to indicate a general direction of a portion of the second fluid stream. The release angle R can be varied to be positive or negative to direct portions of the second fluid flow into or away from the centerline of the first fluid stream to impact the formation of the countercurrent mixing region.

In addition, features of the nozzle assemblies of the present disclosure can be varied to optimize performance in different applications. For example, and in no way limited to the example embodiment of FIG. 7, the ratio of d/D may be of importance in some applications, for example to reduce the ratio of gas-to-liquid flow required for atomization or mixing. Also, the gap height h can also be important and can be varied (both positive and negative, i.e., to place the post end 326 outside or inside the inner tube 302) to accommodate different fluids as well as for frequency control when periodicity is present.

Figure 8:
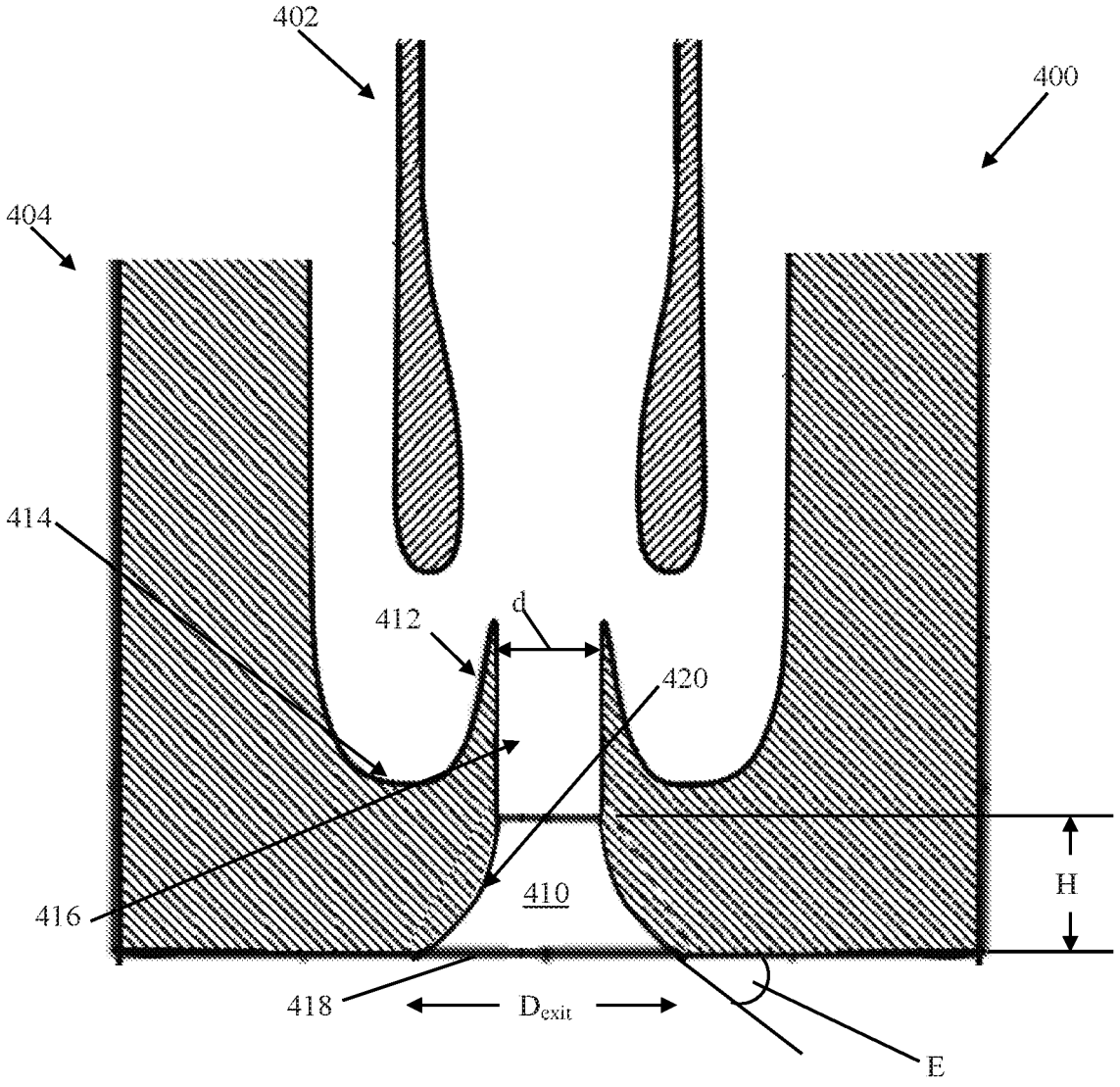
FIG. 8 is an enlarged, simplified cross-sectional view of portions of another nozzle assembly in accordance with principles of the present disclosure.

In addition to the variations described above, other nozzle assemblies of the present disclosure can incorporate a differently shaped or configured exit orifice (i.e., the nozzle assemblies of the present disclosure are not limited to the uniformly or linearly shaped exit orifices 110 (FIG. 2D), 320 (FIG. 7) implicated by the views). For example, portions of another embodiment nozzle assembly 400 in accordance with principles of the present disclosure are shown in simplified form in FIG. 8. The nozzle assembly 400 can be akin to any of the nozzle assemblies described above and includes an inner tube 402 and an outer housing 404. The inner tube 402 can be identical to the inner tube 302 (FIG. 7), or can have any other construction implicated by the present disclosure (e.g., the inner tube 402 need not form the curved interior surface). The outer housing 404 can be highly akin to the outer housing 304 (described above), and forms an exit orifice 410. A guide post 412 is carried or formed by the outer housing 404 as an extension from a guide surface 414 (that is optionally curved), forming a lumen 416 having a diameter d. The exit orifice 410 is open to the lumen 416, and to an exterior of the outer housing 404 at an exit opening 418. With the embodiment of FIG. 8, a wall surface 420 of the exit orifice 410 exhibits a curvature in the longitudinal direction, with a diameter of the exit orifice 410 expanding from the lumen 416 to the exit opening 418. With embodiments in which the lumen 416 is linear and thus has a uniform diameter, the exit orifice 410 can be viewed as having a height H as a linear distance from the lumen 416 to the exit opening 418. The curvature of the orifice wall surface 420 establishes an exit angle E, and the exit orifice 410 has a diameter $D_{exit}$ at the exit opening 418. With these descriptions in mind, a shape of the orifice wall surface 420 can be tailored or configured in accordance with a desired end use application. The orifice wall surface 420 can be curved, and can expand in a direction of the exit opening 418, taper in a direction of the exit opening 418, or be completely straight. Other parameters can also be "tuned", including the exit angle R, the ratio $d/D_{exit}$, the ratio $D_{exit}/H$, etc.

EXAMPLE

Objects and advantages of the present disclosure are further illustrated by the following non-limiting example. The particular materials and amounts thereof recited in these examples, as well as other conditions and details, should not be construed to unduly limit the present disclosure.

Figure 9:
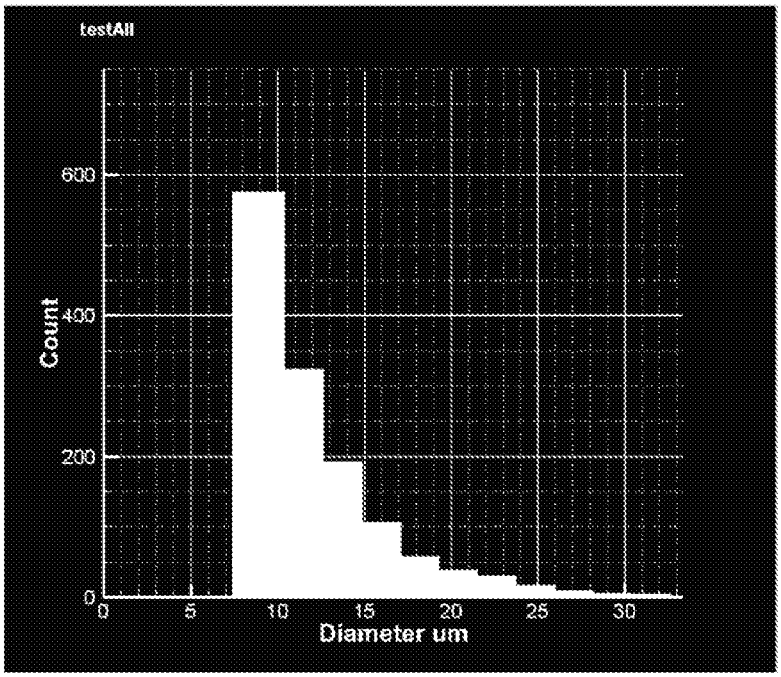
FIG. 9 is a histogram plot of droplet size distribution of an atomized spray provided by an example nozzle assembly of the Example section.

An example nozzle in accordance with principles of the present disclosure was constructed in accordance with FIGS. 2A-4 and corresponding descriptions. The guide post projected into the inner tube (i.e., proximal the outlet end of the inner tube) a distance of approximately 1 mm. To evaluate viability of the example nozzle in generating atomized liquid flow, a source of pressurized water was connected to the inner tube inlet and a source of pressurized air was connected to the outer housing fluid entry port (i.e., liquid served as the first fluid flow F1, and gas served as the second fluid flow F2). The pressurized source of water and the pressured source of air were operated to establish a water (or liquid) flow rate of 12 ml/min, and air-to-water ratio (based on mass) of 2.5, a water pressure of approximately 60 psi and an air pressure of approximately 60 psi. Droplet size in the atomized liquid flow exiting the example atomizer nozzle was measure using Shadowgraphy. FIG. 9 is a histogram plot of the measured droplet size, and evidences that the example nozzle generated an acceptable levels of atomization.

The nozzle assemblies and corresponding methods of mixing fluid flows (e.g., atomizing liquid flow) of the present disclosure provide a marked improvement over previous designs. By counterflowing two fluid flows, a highly unstable velocity profile within the flow column of the nozzle is generated, resulting in rapid mixing. Pulsed mixed fluid flow is also optionally available, and can, in some embodiments, be selected or fine-tuned by a user. The nozzle assemblies and methods of the present disclosure are useful in multiple different mixing scenarios (e.g., gas-gas systems, liquid-liquid systems, and liquid-gas systems), including, but not limited to, atomizing a plethora of different liquids for virtually any spraying application, and are well-suited, for example, for atomizing higher viscosity liquids such as bio-oils. By way of further non-limiting example, the nozzle assemblies and methods of the present disclosure can be incorporated into a combustion engine; the nozzle assembly may improve the combustion of bio-oils to the point that the bio-oil could be used as a drop-in fuel for the combustion engine. This optional application could be highly important as it reduces the overall energy and cost in biofuel refining. Also, engine durability and fuel economy could be improved. Other non-limiting examples of liquids useful with the nozzle assemblies and methods of the present disclosure include conventional fuels, paints, insecticides, herbicides, etc.

Although the present disclosure has been described with reference to preferred embodiments, workers skilled in the art will recognize that changes can be made in form and detail without departing from the spirit and scope of the present disclosure.

What is claimed is:

1. A nozzle assembly comprising:

an inner tube terminating at an outlet end and defining a first flow passage open to the outlet end for directing a first fluid flow to the outlet end in a primary flow direction; and an outer housing including a tubular side wall and an end wall, wherein the tubular side wall defines a central axis, and further wherein the end wall defines an exit orifice and an interior guide structure;

wherein the inner tube is assembled to the outer housing such that the outlet end is axially aligned with the exit orifice and such that a segment of the inner tube, including the outlet end, is radially within the tubular side wall to establish a second flow passage between the inner tube and the outer housing;

and further wherein the interior guide structure is configured and arranged relative to the outlet end to direct at least a portion of a second fluid flow from the second flow passage toward the outlet end in a direction opposite the primary flow direction for mixing the first and second fluid flows.

2. The nozzle assembly of claim 1, wherein the nozzle assembly is configured such that an axial distance between the outlet end and the end wall is adjustable.

3. The nozzle assembly of claim 1, wherein the outer housing defines opposing, first and second sides, the end wall being located at the first side, and further wherein:

the end wall includes a guide surface and a guide post;

the guide surface extends radially inwardly from the tubular side wall; and the guide post is radially spaced from the tubular side wall and projects from the guide surface in a direction of the second side.

4. The nozzle assembly of claim 3, wherein the guide post forms a lumen that is fluidly open to the exit orifice for directing fluid flow from the outlet end to the exit orifice.

5. The nozzle assembly of claim 3, wherein the guide post terminates at a post end opposite the guide surface, and further wherein an axial distance between the outlet end and the guide surface is greater than an axial distance between the outlet end and the post end.

6. The nozzle assembly of claim 5, wherein the nozzle assembly is configured to be transitionable between first and second states, the first state including the post end located axially beyond the outlet end, and the second state including the post end located within the first flow passage.

7. The nozzle assembly of claim 3, wherein a gap is defined between the outlet end and the guide surface, and further wherein the gap is fluidly open to the first and second flow passages at the outlet end for permitting fluid flow from the second flow passage to the first flow passage.

8. The nozzle assembly of claim 7, wherein the guide post is a conical ring-shaped body having an outer diameter that is less than an inner diameter of the inner tube.

9. The nozzle assembly of any of claim 7, wherein the inner tube and the outer housing are selectively movable relative to one another to vary an axial length of the gap.

10. The nozzle assembly of claim 3, wherein a spiral step is formed along an exterior face of the guide post for imparting a swirl into fluid flow passing along the exterior face.

* * * * *